United States Patent [19]

Gomez et al.

[11] Patent Number: 4,545,854

[45] **Date of Patent: * Oct. 8, 1985**

[54] METHOD FOR PREPARING A FIBROUS PRODUCT CONTAINING CELLULOSIC FIBERS AND USEFUL IN PARTICULAR, IN THE FIELD OF COVERINGS IN LIEU OF ASBESTOS

[75] Inventors: Daniel Gomez; Giampaolo Bartoli, both of Charavines, France

[73] Assignee: Arjomari-Prioux, Paris, France

[ * ] Notice: The portion of the term of this patent subsequent to May 26, 1999 has been disclaimed.

[21] Appl. No.: 555,835

[22] Filed: Nov. 28, 1983

Related U.S. Application Data

[63] Continuation of Ser. No. 260,181, May 4, 1981, abandoned, which is a continuation-in-part of Ser. No. 963,015, Nov. 22, 1978, Pat. No. 4,269,657.

[30] Foreign Application Priority Data

Nov. 23, 1977 [FR] France ..... 77 35245

[51] Int. Cl.[4] ..... D21H 1/10

[52] U.S. Cl. ..... 162/135; 162/145; 162/158; 162/168.1; 162/169; 162/183; 162/184; 162/181.1; 427/389.9; 427/391; 427/394; 427/395; 428/281; 428/288

[58] Field of Search ..... 162/142, 135, 169, 168.1, 162/168.2, 168.3, 145, 158, 181.1, 181.8, 164.1, 184, 183, 181.6; 427/389.9, 391, 394, 395; 428/281, 288

[56] References Cited

U.S. PATENT DOCUMENTS 4,011,130 3/1977 Worden ..... 162/181.1
4,245,689 1/1981 Grard et al. ..... 162/169

*Primary Examiner*—Peter Chin
*Attorney, Agent, or Firm*—Bacon & Thomas

[57] ABSTRACT

The present invention is concerned with a new method for preparing a fibrous product containing cellulosic fibers and which is useful, in particular in lieu of asbestos, in the field of covering panels such as for instance wall and floor covering panels. Said method comprises the formation of a sheet according to a paper-making technique from an aqueous suspension comprising:

slightly refined cellulosic fibers having a Schopper-Riegler degree comprised between 15 and 35, in association, if the occasion arises, with non-cellulosic fibers,
an inorganic flocculating agent,
an organic polymeric binder, and
an inorganic filler, and the squeezing of the wet drained sheet under a linear load of 5 to 35 kg/cm, then the drying of the squeezed sheet.

The sheet thus obtained is, if the occasion arises, subjected to a mechanical and/or chemical complementary treatment.

The invention is also concerned with the sheet obtained according to this method, as a new industrial product.

22 Claims, No Drawings

METHOD FOR PREPARING A FIBROUS PRODUCT CONTAINING CELLULOSIC FIBERS AND USEFUL IN PARTICULAR, IN THE FIELD OF COVERINGS IN LIEU OF ASBESTOS

This application is a continuation, of application ser. no. 260,181, filed May 4, 1981 abandoned, which is a continuation-in-part of ser. no. 963,015, filed Nov. 22, 1978 now U.S. Pat No. 4,269,657.

OBJECT OF THE INVENTION

This invention is concerned with a new method of preparation of a fibrous product which contains cellulosic fibers and can replace asbestos in particular in the field of covering panels such as wall covering panels and floor covering panels.

It is aimed in particular at the obtaining of a support comprising cellulosic fibers associated, if the occasion arises, with non-cellulosic fibers, having good dimensional and thermal stability, resistance to water and the humidity in the air and intended in particular to replace asbestos in the production of coverings such as floor coverings which are called as "cushion floor".

CROSS REFERENCE AND PRIOR ART

This previous patent application relates to a method of preparation of a fibrous sheet from an aqueous suspension containing slightly refined cellulosic fibers having a Schopper-Riegler degree comprised between 15 and 35 (in association with non-cellulosic fibers, if needed), a polymeric cationic flocculating agent, an organic polymeric binder and an inorganic filler, which comprises a draining an squeezing phase under a reduced linear pressure of 5–35 kg/cm.

The present invention is concerned with a similar method of preparation in which the flocculating agent is an inorganic one.

It is known from U.S. Pat. No. 2,657,991 (WALSH et al.) and British Pat. No. 1,378,759 to prepare a paper sheet from an aqueous suspension of cellulosic fibers having according to U.S. Pat. No. 2,657,991, a Schopper-Riegler degree of 16–80 (i.e., a Canadian Freeness of respectively 600–50), and according to British Pat. No. 1,378,759 a Schopper-Riegler degree of 8–15, an inorganic flocculant such as aluminium sulphate, an organic binder and an inorganic filler. The method according to the present invention is different from the teaching of both U.S. Pat. No. 2,657,991 and British Pat. No. 1,378,759, in particular by the fact that squeezing of the draining sheet is carried out under a reduced squeezing pressure of 5–35 kg/cm instead of a common squeezing pressure which is higher than or equal to 50 kg/cm.

DETAILED DESCRIPTION OF THE INVENTION

It is known that the employment of asbestos in covering panels implies (i) recourse to complicated installations bringing about considerable investment and operational expenses, and (ii) respect for very strict rules of safety and hygiene in order to avoid any risk of absorbtion or inhalation of asbestos fibres and dust.

It is likewise known that if asbestos supports exhibit good properties of dimensional and thermal stability and imputrescibility, they do not posess good mechanical properties because they have poor internal cohesion and poor resistance to traction and to tearing.

It is likewise known that it has been proposed to replace asbestos by a fabric comprising cotton and glass wool fibers. Such a fabric displays the disadvantage of being much too stiff.

In order to solve the technical problem of replacement of asbestos, a solution is proposed in accordance with the invention, which is different from that of the prior mixture of cotton and glass wool and which calls upon techniques which are purely those of papermaking. Thus, the technical solution in accordance with the invention uses conventional papermaking means of manufacture and coating such as flat or inclined or vertical table machines, size-presses, master scrapers, air blades, trailing blades, or rolled coaters and mechanical means such as refining, pressing, and if the occasion arises, smoothing.

The main objects of the inventlon are to alleviate the disadvantages of the prior art, in particular those connected with the employment of asbestos, and to propose a fibrous product which can replace asbestos and has interesting properties as far as dimensional and thermal stability, elasticity, internal cohesion and resistance to traction and tearing are concerned. By "fibrous product" is understood here a composite product containing cellulosic fibers in association, if the ocassion arises, with non-cellulosic fibers.

According to the invention it is proposed a new method of preparation of a fibrous cellulosic fibers-containing product having good dimensional and thermal stability, elasticity and resistance to traction and tearing, which comprises the steps of (a) producing a flow of an aqueous suspension through a machine of the paper-making type, the aqueous suspension comprising:

100 parts by weight of fibers selected from the group consisting of (i) slighly refined cellulosic fibers having a Schopper-Riegler degree comprised between 15 and 35, and (ii) mixtures of said slightly refined cellulosic fibers with non-cellulosic fibers in which the weight ratio of non-cellulosic fibers to cellulosic fibers is lower than or equal to 0.1, 1 to 5 parts by weight of an inorganic flocculating agent, 5 to 30 parts by weight of an organic polymeric binder, and 30 to 60 parts by weight of an inorganic filler, to form a wet sheet, (b) draining and squeezing the wet sheet under a linear squeezing pressure of 5 to 35 kg/cm, and (c) drying the drained squeezed sheet.

It is also proposed according to the invention to subject the dry sheet thus obtained to a mechanical and/or chemical complementary treatment. Mechanical complementary treatments include surface treatments such as glazing, calendring and graining. Chemical complementary treatments include surfacing, coating and impregnation.

In other words, the method according to the invention comprises two stages, namely :

Stage 1 which deals with the obtention of a dry sheet, and

Stage 2, which deals with a complementary treatment.

In Stage 1, it is important from the point of view of the elasticity of the final product that the cellulosic fibers, which are used, are slightly refined, that is to say, that they exhibit before the treatment in accordance with the invention a Schopper-Riegler degree (measured after initial refining as a thick paste) comprised between 15 and 35, and preferably between 15 and 25. In fact, experience shows that if more refined fibers are employed, in particular cellulosic fibers having a Schopper-Riegler degree of 40 to 60 which come into play in a general way in the manufacture of paper, the final product is no longer as elastic as the product in accordance with the invention. From the practical point of view the best results in accordance with the invention are obtained with cellulosic fibers having a Schopper-Riegler degree of preferably 15 to 25, and more preferably of 20 to 25.

If the occassion arises, non-cellulosic fibers may be associated with the cellulosic fibers. By non-cellulosic fibers are understood here mineral fibers such as, for instance, glass fibers and organic fibers such as, for instance, polyamide and polyester fibers which are dispersible in water and are used in a classical way in the manufacture of paper.

In practice, when cellulosic fibers are associated with non-cellulosic fibers, a quantity will advantageously be employed which is less than or equal to 10 parts by weight of non-cellulosic fibers per 100 parts by weight of cellulosic fibers. In accordance with a preferred embodiment, the resistance of the final product to the humid state is improved by employing a mixture of fibers comprising 3 to 6 parts by weight of glass fibers (of 3 to 8 mm in length) and 100 parts by weight of cellulosic fibers.

The inorganic flocculating agent fulfills two functions: it ensures the precipitation of the binder onto the fibers by modifying the electric charge of the said fibers and it improves the resistance to the humid state. When the fibers are cellulosic fibers or a mixture of cellulosic fibers with non-cellulosic fibers in which the cellulosic fibers are preponderant, the flocculating agent cationizes the cellulosic fibers in order to render them substantive. Advantageously, 1 to 5 parts by weight of inorganic flocculating agent will be employed per 100 parts by weight of fibers. Amongst the flocculating agents which may be employed, may be mentioned in particular, but non-restrictively, the following ones: aluminium sulphate, alum (a variety of aluminium sulphate) and aluminium chloride which are non-polymeric inorganic substances.

The binding agent fulfills essentially two functions: to favour the flexibility, the internal cohesion, the dimensional stability in the dry state and in the wet state and the resistance to tearing of the finished product, on the one hand, and to avoid the delamination of the fibrous mats during the treatment of Stage 2, on the other hand. Advantageously, 5 to 30 parts by dry weight, preferably 10 to 15 parts by dry weight, will be employed of an organic polymeric binding agent (for instance a latex) per 100 parts by weight of fibers.

Amongst the binders which are suitable may be mentioned in particular the polymers and copolymers obtained from the following monomers: acrylic acid, methacrylic acid, acrylonitrile, methacrylonitrile, acrylates and methacrylates of alkyl in $C_1$–$C_4$, acrylamide, methacrylamide, N-methylolacrylamide, styrene, butadiene, as well as mixtures of the said polymers and copolymers. In particular, there may be employed as binders acrylic acid-acrylonitrile, acrylic acid-acrylonitrile-acrylate-acrylamide, styrene-butadiene, butadiene-acrylonitrile, butadiene-acrylonitrile-methacrylic acid copolymers. By way of non-restrictive examples, the following polymers in mass may be employed:

the "polymer A" which contains 87 to 9o parts by weight of ethylacrylate unit, 1 to 8 parts by weight of acrylonitrile unit, 1 to 6 parts by weight of N-methylolacrylamide unit and 1 to 6 parts by weight of acrylic acid unit;

the "polymer B" which contains 60 to 75 parts by weight of ethylacrylate unit, 5 to 15 parts by weight by acrylonitrile unit, 10 to 20 parts by weight of butylacrylate unit, 1 to 6 parts by weight of N-methylolacrylamide unit and 1 to 6 parts by weight of acrylamide unit;

the "polymer C" which contains 60 to 65 parts by weight of butadiene unit, 35 to 40 parts by weight of acrylonitrile unit and 1 to 7 parts by weight of methacrylic acid unit;

the "polymer D" which contains 38 to 50 parts by weight of styrene unit, 47 to 59 parts by weight of butadiene unit, and 1 to 6 parts by weight of methyl-acrylamide unit;

the "polymer E" which contains 53 to 65 parts by weight of styrene unit, 32 to 44 parts by weight of butadiene unit and 1 to 6 parts by weight of methyl-acrylamide unit.

The inorganic fillers used here are identical to those employed in the usual way in the paper industry. In particular, calcium carbonate, CaO , kaolin and talc are suitable. Advantageously, 30 to 60 parts by dry weight and more advantageously 35 to 50 parts by dry weight of inorganic non binding filler will be employed per 100 parts by weight of fibers.

Other additives may be introduced in the aqueous suspension of Stage 1. It is a matter mainly of ingredients which come into play in an ordinary way in the paper industry, namely :

a sizing agent (in order to reduce the absorbtion of water by the fibers) such, in particular, as the anhydrides of dicarboxylic acids, the dimeric alkyl-ketenes and paraffin emulsions (advantageously 0.1 to 2 parts by weight of at least one sizing agent will be employed per 100 parts by weight of fibers);

a retention aid chosen, for instance, from the group consisting of polyacrylic acids, polyacrylamides, polyamines, polyamides, styrene-butadiene copolymers, acrylic acid-acrylonitrile copolymers, butadiene-acrylonitrile copolymers, and ammonium salts (advantageously 0.1 to 2 parts by weight per 100 parts by weight of fibers);

a lubrication agent, the preferred lubrication agents from Stage 1 in accordance with the invention being fatty acid derivatives so as to favour anti-adherence of the resulting sheet to the wet presses, the felts and the dryer cylinders (advantageously 0.2 to 4 parts by weight of lubrication agent per 100 parts by weight of fibers);

other additives, if needed, such in particular as one or more agents for resistance to the dry state such as cold-soluble starch, alginates, mannogalactans, and galactomannan ethers, one or more colorants (those suitable, in particular, according to need, are the acid basic or direct colorants), and one or more antibiotic agents.

The sheet obtained in Stage 1 which has in general a weight of 300 to 600 g/m$^2$ is next advantageously subjected to the complementary treatment of Stage 2 after having been drained and dried.

Stage 2 mainly comprises a chemical treatment (surfacing, coating or impregnation) of the sheet by means of a aqueous bath (suspension or dispersion) containing a binder, for instance, a latex and, if needed an inorganic filler and, if the occasion arises, other additives.

The binder is employed in Stage 2 for reinforcing the mechanical properties and reducing the absorbtion of the sheet with respect to water and PVC plasticizers such as dioctylphthalate. The binder may be a polymer currently employed in the paper industry for this purpose For example, one of the binders of Stage 1 may be called upon, associated if the occasion arises, with a sizing agent and/or a surface sizing agent. The polymers A, B, C, D, and E are particularly suitable, as well as their associations with the inorganic filler and retention aid.

In the aqueous suspension of the chemical treatment bath, the binder is advantageously at a concentration of 400 to 550 g/1.

The inorganic filler employed in Stage 2 may be one of the inorganic fillers of Stage 1. For this purpose, it is recommended to employ 10 to 40 parts by dry weight of inorganic filler per 100 parts by weight of binder. One may, for example, employ kaolin previously put into aqueous suspension at 650 g/1 in the presence of an organic or inorganic dispersant agent.

Amongst the additives which it may be advantageous to incorporate in the chemical treatment bath of Stage 2, may be mentioned in particular the additives $\alpha$ to $\delta$ below. Hence, the chemical treatment bath may contain at least one of the said additives and preferably a mixture of at least one additive of each kind.

The mixture preferred for this purpose comprises:

($\alpha$) a sizing agent at the rate of 5 to 10 parts by weight of said agent per 100 parts by weight of binder (amongst the sizing agents which are suitable here may be mentioned the dimeric alkylketenes and paraffin emulsions);

($\beta$) an anti-foaming agent at the rate of 0.1 to 0.3 part by weight of said agent per 100 parts by weight of binder;

($\gamma$) a lubricating agent at the rate of 0.5 to 2 parts by weight of said agent per 100 parts by weight of binder, the lubricating agent preferred being here ammonium stearate which gives better results than the metallic stearates (Ca and Mg); and ($\delta$) at least one antibiotic substance chosen from the group consisting of the bactericides and the fungicides; advantageously two antibiotics will be employed one acting mainly as bactericide and the other as fungicide, the preferred proportions of each antibiotic substance being 1500 to 2500ppm by weight with respect to the weight of the sheet obtained in Stage 1 and, in particular, 1500 to 2500 ppm of bactericide and 1500 to 2500ppm of fungicide.

With a bactericide and a fungicide one obtains the imputrescible character desired for replacing asbestos. Amongst the antibiotics employable may be mentioned in particular 2-(4-thiazolyl)-benzimidazole, 2-(thiocyano-methylthio)-benzothiazole, zinc pyridinethione, pimaricine, dodecyl-guanidine, methylene-bis-thiocyanate, 1, 4-bis-(bromoacetoxy)-2-butene and zinc 2-mercaptobenzo-thiazole, each of these substances being preferably employed at the rate of 1500 to 2500 g per ton of sheet from Stage 1 to be treated.

BEST MODE

The best mode for carrying out the method of preparation according to the invention consists:

at Stage 1, in introducing under stirring into a tank fibers in suspension in water, the inorganic flocculating agent and the inorganic filler; this mixture is next transferred into a storage tank whence it is withdrawn continuously into the head circuits of the paper machine; into these head circuits is introduced continuously the organic polymeric binder, the resulting mixture is then introduced continuously into the head box of the paper machine and a sheet is obtained which is drained, squeezed under a linear pressure of 5–35 kg/cm, then dried; in a first variation of Stage 1, the inorganic flocculating agent and the organic polymeric binder are introduced simultaneously into the papermachine head circuits; in a second variation of Stage 1 the inorganic flocculating agent is introduced in two steps: a first fraction into the head circuits at the same time as the binder, then a second fraction into the head box;

at Stage 2, in treating the sheet obtained at the end of Stage 1, by means of an aqueous suspension containing an organic polymeric binder (preferably a latex), an antifoam agent, an inorganic filler (which has been previously put into aqueous suspension in the presence of a dispersing agent), a sizing agent, a lubricating agent (preferably ammonium stearate), a bactericide and a fungicide.

EXAMPLES OF PREPARATION

Other advantages and characteristics of the invention will be better understood from the reading which is to follow of examples in no way restrictive, but given by way of illustration.

EXAMPLE 1

Stage 1

A sheet is prepared by means of a paper machine from an aqueous suspension comprising in parts by dry weight:

| | |
|---|---|
| cellulosic fibers (having a S.R. degree of 25) | 100 parts |
| inorganic filler ($CaCO_3$) | 35 parts |
| flocculant ($AlCl_3$) | 1 part |
| binder (acrylic latex) | 10 parts |

The slightly refined cellulosic fibers are put into suspension in water (between 2 and 4% w/v) and into the said suspension is introduced the flocculant (diluted 3 to 10 times in water) and the inorganic filler (in suspension in water at 40 to 70% w/v). The resulting mixture is distributed continuously into the head circuits wherein the binder (diluted 3 to 10 times in water) is introduced. The dry weight concentration of substances in the head box is preferably comprised between 10 to 20 g/1. Draining is carried out according to a conventional means and squeezing is carried out in the wet portion of the paper machine under a linear pressure of 20 kg/cm. After drying, a sheet of about 300 to 400 g/m$^2$ is obtained.

Stage 2

The sheet from Stage 1 is subjected to a surface treatment by means of an aqueous suspension or dispersion of acrylic latex (the said latex being at a concentration of 400 to 550 g/1) comprising:

| | |
|---|---|
| acrylic latex | 100 parts by weight |
| kaolin | 10 to 40 parts by weight |
| Dimeric alkylketene | 5 to 10 parts by weight |
| ammonium stearate | 0.5 to 2 parts by weight |
| antifoaming agent | 0.1 to 0.3 parts by weight |
| Methylene-bis-thiocyanate | 1500 to 2500 ppm with re- |

-continued

| | |
|---|---|
| | spect to the weight of the sheet from Stage 1 |
| 2-(thiocyanomethylthio)-benzothiazole | 1500 to 2500 ppm with respect to the weight of the sheet from State 1 |

The uptake desired is from 20 to 30 g/m$^2$ after drying.

EXAMPLE 2

Stage 1

According to the process disclosed in Stage 1 of Example I, a fibrous sheet is obtained from an aqueous suspension comprising in parts by dry weight:

| | |
|---|---|
| cellulosic fibers (having a S.R. degree of 25) | 100 parts |
| inorganic filler (kaolin) | 35 parts |
| inorganic flocculant ($AlCl_3$) | 1 part |
| binder (acrylic latex) | 10 parts |

After draining and squeezing (20 kg/cm) in the wet portion then drying, a sheet weighing from about 300 to 400 g/m$^2$ is obtained.

Stage 2

The foregoing sheet is size-pressed by means of an aqueous suspension or dispersion of acrylic latex (in which the said latex is at a concentration of 400 to 550 g/1) comprising:

| | | |
|---|---|---|
| Acrylic latex | 100 parts by weight | |
| kaolin | 10 to 40 parts by weight | |
| antifoam | 0.1 to 0.3 parts by weight | |
| paraffin emulsion | 2 to 15 parts by weight | |
| Ammonium stearate | 0.5 to 2 parts by weight | |
| 2-(4-thiazobyl)-benzimidazole | 1500 to 2500 ppm | with respect to the weight of the sheet from Stage 1 |
| 1,4-bis-(bromoacetoxy)-2-butene | | |

The uptake desired is from 20 to 30 g/m$^2$.

EXAMPLE 3

Stage 1

A sheet is prepared by means of a paper machine from an aqueous suspension comprising in parts by dry weight:

| | |
|---|---|
| cellulosic fibers (having a S.R. degree of 25) | 83 parts |
| inorganic filler (kaolin) | 15 parts |
| inorganic flocculant [$Al_2(SO_4)_3$] | 3 parts |
| binder (acrylic latex) | 10 parts |

The slightly refined cellulosic fibers are put into suspension in water (between 2 and 4% w/v) and into the said suspension is introduced the inorganic filler (previously suspended in water at 40–70% w/v), then simultaneously the binder (diluted 3 to 10 times in water) and 1 part by dry weight of $Al_2(SO_4)_3$ (diluted 3 to 10 times in water). Into the head box 2 parts by dry weight of $Al_2(SO_4)_3$ (diluted 3 to 10 times in water) are introduced. The dry weight concentration of substances in the head box is preferably comprised between 10 to 20 g/1. Draining is carried out according to a conventional means and squeezing is performed under a linear pressure of 20 kg/cm. After drying, a sheet of about 300 to 400 g/m$^2$ is obtained.

Stage 2

The foregoing sheet is surface treated by means of an aqueous suspension or dispersion of acrylic latex (in which the said latex is at a concentration of 400 to 550 g/1) comprising:

| | | |
|---|---|---|
| Acrylic latex (Polymer A) | 100 parts by weight | |
| Kaolin | 10 to 40 parts by weight | |
| Antifoaming agent | 0.1 to 0.3 parts by weight | |
| paraffin emulsion | 2 to 15 parts by weight | |
| Ammonium stearate | 0.5, to 2 parts by weight | |
| 2-(thiocyanomethylthio)-benzothiazole | 1500 to 2500 ppm | with respect to the weight of sheet from St. 1 |
| Mixture of zinc pyridinethione and zinc 2-mercaptobenzothiazole (2,5:1) by weight | 1500 to 2500 ppm | |

The uptake desired is from 20 to 30 g/m$^2$.

EXAMPLE 4

A sheet is prepared by means of a paper machine from an aqueous suspension comprising in parts by weight:

| | |
|---|---|
| Essential components | 100 parts |
| cellulosic fibers [a (80:20) w/v mixture of half-bleached softwood kraft and half-bleached hardwood kraft, having a S.R. degree of 20] | |
| inorganic filler (talc) | 60 parts |
| inorganic flocculant ($AlCl_3$) | 2 parts |
| binder (latex: polymer A or E) | 15 parts |
| Other additives | |
| sizing agent | 0.2 part |
| retention aid (acrylic and acrylamide copolymer) | 0.2 part |
| antifoam agent | 0.1 to 0.3 part |
| lubricant (ammonium stearate) | 1 part |

Into the aqueous suspension of fibers (2–4% w/v) are introduced the flocculant (previously diluted 3–10 times in water), the inorganic filler (previously suspended in water at 40–70% w/v), the sizing agent (dimeric alkylketene), the antifoam agent. The resulting mixture is distributed continuously into the head circuits wherein are continuously introduced the binder (previously diluted 3–10 times in water), the retention aid and the lubricant agent. The resulting mixture is then introduced into the head box wherein the dry weight concentration is comprised between 10 and 20 g/1. After draining, squeezing (20 kg/cm) and drying, a sheet weighing from 300 to 400 g/m$^2$ is obtained.

EXAMPLE 5

The sheet obtained in Example 4 is surface treated (size press) in accordance with the details described under Stage 2 of Example 2. The uptake desired is from 20 to 30 g/m$^2$.

EXAMPLE 6

According to the process disclosed in Stage 1 of Example 1, a fibrous sheet is obtained from an aqueous suspension comprising in part by dry weight:

| | |
|---|---|
| cellulosic fibers (having a SR degree of 25) | 96 parts |
| glass fibers | 4 parts |
| inorganic filler (CaO) | 50 parts |
| inorganic flocculant ($AlCl_3$) | 3 parts |
| binder (Polymer A) | 15 parts |

After draining, squeezing (5 to 35 kg/cm) and drying, a sheet weighing 300 to 600 g/m$^2$ is obtained.

EXAMPLE 7

The sheet obtained in Example 6 is subjected to a surface treatment in accordance with the details described under Stage 2 of Example 3. The uptake desired is from 20 to 30 g/m$^2$.

EXAMPLE 8

Stage 1

According to the process disclosed in Stage 1 of Example 1, a fibrous sheet is obtained from an aqueous suspension comprising in parts by weight:

| | |
|---|---|
| cellulosic fibers (having a SR degree of 25) | 100 parts |
| inorganic filler (CaO) | 35 parts |
| inorganic flocculant (alum) | 3 parts |
| binder (acrylic latex) | 10 parts |

After draining and squeezing (20 kg/cm) in the wet portion of the paper machine, then drying, a sheet weighing from 300 to 400 g/m$^2$ is obtained.

Stage 2

The sheet thus obtained is subjected to a size-press treatment according to Stage 2 of Example 2.

Comparative assays have been carried out in order to compare the use of an inorganic flocculating agent according to the method of the invention with (i) the use of a polymeric cationic agent according to the parent U.S. patent application serial No. 963,015, and (ii) prior art teaching. Handsheet samples have been prepared according to the working conditions given in Table I below for comparing, on the one hand, samples according to Stage 1 of Examples 1-2 and respectively 8 (coded as F 9804, F 9825 and respectively F 9106A) with a similar sample (F 9255) according to the parent application and two samples according to the teaching of WALSH et al. U.S. Pat. No. 2,657,991 (coded as F 9107 and respectively F 9108), and on the other hand, a sample according to Stage 1 of Example 3 (coded as F 9794) with a similar sample according to the parent application (F 9256) and two samples according to the teaching of British patent No. 1,378,759 (coded as F 9109 and respectively F 9260).

These handsheet samples obtained in a dry state were not subjected to a surface treatment according to Stage 2, but tested oven-dried during 2 minutes at 200° C. in order to determine their physical and mechanical properties, which are reported in Table II.

The data of Table I and II show that (i) the use of an inorganic non-polymeric flocculant leads to products having physical and mechanical properties similar to those obtained according to the parent application with a polymeric cationic flocculant, (ii) Stage 1 of the invention gives products exhibiting properties which are more interesting than those of the products obtained according to the prior art teaching (see in particular the Cobb D.O.P. values).

The fibrous sheets obtained according to Stage 1 or Stage 2 of this invention are useful as supports for floor and wall coverings. As floor covering supports, they exhibit good physical and mechanical properties and they present the advantage of a lower dioctylphthalate absorption.

TABLE I

INGREDIENTS (IN PARTS BY DRY WEIGHT), WORKING CONDITIONS AND OBSERVATIONS (LOSS UNDER WIRE AND DRAINING DURATION)

| | F 9804 | F 9825 | F 9106 A | F 9255 | F 9107 | F 9108 |
|---|---|---|---|---|---|---|
| cellulosic fibers | 100 | 100 | 100 | 100 | 100 | 100 |
| (°SR) | (25) | (25) | (25) | (25) | (25) | (25) |
| inorganic filler | 35(a) | 35(b) | 35(c) | 35(a) | 35(a) | 35(a) |
| flocculant | 1(d) | 1(d) | 3(e) | 3(f) | 10(e) | 10(e) |
| binder (g) | 10 | 10 | 10 | 10 | 100 | 10 |
| retention acid | — | — | — | — | — | — |
| head box flocculant | — | — | — | — | — | — |
| pH | 7.0 | 6.7 | 7.2 | 7.5 | 7.2 | 7.2 |
| squerzing pressure | 20 kg/cm | 20 kg/cm | 20 kg/cm | 20 kg/cm | 20 kg/cm | 20 kg/cm |
| loss under wire (% by weight) | 1.3% | 1.7% | 4% | 2% | 10% | 15.4% |
| draining duration (seconds) | 12 sec. | 13 sec. | 11 sec. | 11 sec. | 20 sec. | 10 sec. |

Notes
(a): $CaCO_3$;
(b): kaolin;
(c): CaO;
(d): $AlCl_3$;
(e): alum;
(e'): $Al_2(SO_4)_3$;
(f): polyamine-polyamine-epichlorhydrine resin;
(g): acrylic latex.

| | F 9794 | F 9256 | F 9109 | F 9260 |
|---|---|---|---|---|
| cellulosic fibers | 83 | 83 | 83 | 83 |
| (°SR) | (15) | (15) | (15) | (15) |
| inorganic filler | 35(b) | 35(b) | 35(b) | 35(b) |
| flocculant | 1(e') | 3.2(f) | 0.41 | 0.7 |
| binder (g) | 10 | 10 | 17 | 17 |
| retention aid (polyacrylamid) | — | — | (h) | (h) |
| head box flocculant | 2(e') | — | — | — |

TABLE I-continued

| INGREDIENTS (IN PARTS BY DRY WEIGHT), WORKING CONDITIONS AND OBSERVATIONS (LOSS UNDER WIRE AND DRAINING DURATION) | | | | |
|---|---|---|---|---|
| pH | 6.6 | 7.2 | 7.2 | 7.1 |
| squerzing pressure | 20 kg/cm | 20 kg/cm | 20 kg/cm | 20 kg/cm |
| loss under wire (% by weight) | 1.9% | 3.2% | 26% | 4% |
| draining duration (seconds) | 6 sec. | 6 sec. | 6 sec. | 5 sec. |

Notes
(a): $CaCO_3$;
(b): kaolin;
(c): CaO;
(d): $AlCl_3$;
(e): alum;
(e'): $Al_2(SO_4)_3$;
(f): polyamid-polyamine-epichlorhydrine resin;
(g): acrylic latex;
(h) "RETEN 210" as indicated in Ex 2 of British patent No 1,378,759 in an amount of 10 ppm.

TABLE II

PHYSICAL AND MECHANICAL PROPERTIES OF OVEN-DRIED SAMPLES (2 minutes at 200° C.)

| | F 9804 | F 9825 | F 9106 A | F 9255 | F 9107 | F 9108 |
|---|---|---|---|---|---|---|
| weight (g/cm$^2$) | 324 | 355 | 352 | 363 | 352 | 350 |
| thickness (μ) | 431 | 428 | 476 | 463 | 383 | 475 |
| bulk (cm$^3$/g) | 1.33 | 1.21 | 1.36 | 1.38 | 1.09 | 1.36 |
| tensile strength (kg) | 22.2 | 20.0 | 26.2 | 26.1 | 19.5 | 20.9 |
| tear index (I-100) | 142 | 141 | 217 | 209 | 113 | 203 |
| internal cohesion (Scott Bond) | >500 | 322 | >500 | >500 | >500 | >246 |
| water absorption (after 24 hours) | 114% | 113% | 80% | 81% | 89% | 109% |
| Cobb D.O.P. 1 mn (a) | 80 | 70 | 80 | 80 | 96 | 109 |

| | F 9794 | F 9256 | F 9109 | F 9260 |
|---|---|---|---|---|
| weight (g/m$^2$) | 330 | 351 | 346 | 355 |
| thickness (μ) | 523 | 484 | 686 | 539 |
| bulk (cm$^3$/g) | 1.58 | 1.38 | 1.98 | 1.52 |
| tensile strength (kg) | 15.8 | 16.4 | 4.3 | 8.1 |
| tear index (I-100) | 167 | 266 | 179 | 205 |
| internal cohesion (Scott Bond) | 120 | 150 | 35 | 90 |
| water absorption (after 24 hours) | 136% | 128% | 219% | 188% |
| Cobb D.O.P. 1 mn (a) | 200 | 180 | 280 | 280 |

Note
(a): absorption of dioctylphthalate in g/m$^2$ after exposure to dioctylphthalate for 1 minute.

What is claimed is:

1. A method of preparation of a fibrous cellulosic fibers-containing product having good dimensional and thermal stability, elasticity and resistance to traction and tearing which comprises the steps of (a) producing a flow of an aqueous suspension through a machine of the paper-making type, the aqueous suspension comprising:

100 parts by weight of fibers selected from the group consisting of (i) slightly refined cellulosic fibers having a Schopper-Riegler degree comprised between 5 and 35, and (ii) mixtures of said slightly refined cellulosic fibers with non-cellulosic fibers in which the weight ratio of non-cellulosic fibers to cellulosic fibers in lower than or equal to 0.1, 1 to 5 parts by weight of an inorganic flocculating agent, 5 to 30 parts by weight of organic polymeric binder, and 30 to 60 parts by weight of an inorganic filler, to form a wet sheet, (b) draining and squeezing the wet sheet under a linear squeezing pressure of 5 to 35 kg/cm, and (c) drying the drained squeezed sheet.

2. A method of preparation of a fibrous cellulosic fibers-containing product having good dimensional and thermal stability, elasticity and resistance to traction and tearing which comprises the steps of (a) producing a flow of an aqueous suspension through a machine of the paper-making type, said aqueous suspension comprising:

100 parts by weight of fibers selected from the group consisting of (i) slightly refined cellulosic fibers having a Schopper-Riegler degree comprised between 5 and 35, and (ii) mixtures of said slightly refined cellulosic fibers with non-cellulosic fibers in which the weight ratio of the non-cellulosic fibers to cellulosic fibers is lower than or equal to 0.1, 1 to 5 parts by weight of an inorganic flocculating agent, 5 to 30 parts by weight of organic polymeric binder, and 30 to 60 parts by weight of inorganic filler, to form a wet sheet;

(b) draining and squeezing the wet sheet;

(c) drying the wet sheet;

(d) treating the surface of the dried sheet thus obtained with an aqueous bath containing a binder and an inorganic filler, wherein the binder is a latex having a concentration of 400 to 550 g/1; and (e) drying the treated sheet.

3. The method according to claim 2, wherein the squeezing of step (b) is carried out under a linear squeezing pressure of 5 to 35 kg/cm.

4. The method according to claim 2 wherein step d) is carried out with 10 to 40 parts by weight of inorganic filler for 100 parts by weight of binder.

5. The method according to claim 1 wherein the cellulosic fibers have a Schopper-Riegler degree of 15 to 25.

6. The method according to claim 5 wherein the cellulosic fibers have a Schopper-Riegler degree of 20 to 25.

7. The method according to claim 1 wherein the non-cellulosic fibers are glass fibers, the weight ratio of glass fibers to cellulosic fibers being comprised between 0.03 and 0.06.

8. The method according to claim 1 wherein the aqueous suspension further comprises at least one substance selected from the group consisting of:

a sizing agent, a retention agent, and a lubricating agent.

9. The method according to claim 8, wherein the lubricating agent is a fatty acid derivative.

10. The method according to claim 1, wherein the flow of the aqueous suspension is continuous.

11. The method according to claim 2, wherein in step d) the aqueous bath comprises at least one antibiotic substance and contains 100 parts by weight of a binder, 10 to 40 parts by weight of an inorganic filler, 5 to 10 parts by weight of a sizing agent, 0.1 to 0.3 parts by weight of an anti-foaming agent and 0.5 to 2 parts by weight of a lubricating agent.

12. The method according to claim 11, wherein the lubricating agent is ammonium stearate.

13. A fibrous cellulosic fibers-containing product having good dimensional and thermal stability, elasticity and resistance to traction and tearing and which is useful for replacing asbestos in the field of coverings, which fibrous product is in the form of a sheet and comprises:

(a) fibers selected from the group consisting of (i) slightly refined cellulosoc fibers having a Schopper-Riegler degree of 15 to 35, and (ii) mixtures of said cellulosic fibers with non-cellulosic fibers in which the weight ratio of non-cellulosic fibers to cellulosic fibers is lower than or equal to 0.1;

(b) 1 to 5 parts by weight of inorganic flocculating agent per 100 parts by weight of fibers;

(c) 5 to 30 parts by weight of organic polymeric binder per 100 parts by weight of fibers;

(d) 30 to 60 parts oy weight of inorganic filler per 100 parts by weight of fibers.

14. A fibrous product according to claim 13 in the form of a sheet, which further comprises a surfacing mixture derived from an aqueous treating bath containing 500 to 550 g/1 of binder and containing 100 parts by weight of binder and 10 to 40 parts by weight of inorganic filler, and dried.

15. A product according to claim 13 in the form of a sheet weighing from 300 to 600 g/m$^2$ and containing per 100 parts by weight of the fibers:

(a) 1 to 5 parts by weight of the inorganic flocculating agent;

(b) 5 to 20 parts by weight of the binder;

(c) 30 to 60 parts by weight of the inorganic filler; and (d) 0.1 to 2 parts by weight of sizing agent.

16. A fibrous product according to claim 13 in the form of a sheet weighing 300 to 600 g/m$^2$ and containing par 100 parts by weight of the fibers:

(a) 1 to 5 parts by weight of the inorganic flocculating agent;

(b) 5 to 20 parts by weight of the binder;

(c) 30 to 60 parts by weight of the inorganic filler;

(d) 0.1 to 2 parts by weight of sizing agent; and (e) 0.2 to 4 parts by weight of a lubricating agent.

17. A fibrous product according to claim 15, in the form of a sheet which comprises 20 to 30 g/m$^2$ by dry weight of a surface finishing product derived from an aqueous treating bath containing 400 to 550 g/1 of a binder, said bath comprising at least one antibiotic substance and containing per 100 parts by weight of binder; 10 to 40 parts by weight of an inorganic filler; 0.1 to 0.3 parts by weight of an antiforming agent; and 0.5 to 2 parts by weight of a lubricating agent.

18. A fibrous product according to claim 17 which further comprises polyvinyl chloride coating.

19. The method according to claim 2 wherein the aqueous suspension contains from 10 to 15 parts by weight of binder.

20. The method according to claim 19 wherein the aqueous suspension contains from 35 to 50 parts by weight of the inorganic filler.

21. The method of claim 19 wherein the binder is continuously introduced at the head circuit of the machine of the paper-making type.

22. The method of claim 20 wherein the binder is continuously introduced at the head circuit of the machine of the paper-making type.

* * * * *